United States Patent [19]

Ramun

[11] Patent Number: 5,020,962

[45] Date of Patent: Jun. 4, 1991

[54] APPARATUS FOR DISMANTLING BUILDINGS

[75] Inventor: John R. Ramun, Youngstown, Ohio

[73] Assignee: Allied Gator, Inc., Youngstown, Ohio

[21] Appl. No.: 580,092

[22] Filed: Sep. 10, 1990

[51] Int. Cl.[5] ..... B66B 17/00; B66C 23/00; B66C 23/82

[52] U.S. Cl. ..... 414/569; 294/92; 212/259; 212/167; 212/186; 212/262

[58] Field of Search ..... 212/167, 186, 223, 232, 212/237, 239, 242, 243, 251, 256, 259, 262; 414/569, 560; 294/92, 65.5; 114/242, 253, 254

[56] References Cited

U.S. PATENT DOCUMENTS

| | | | |
|---|---|---|---|
| 1,240,821 | 9/1917 | Carozza . | |
| 1,448,680 | 3/1923 | Stack | 212/243 |
| 1,851,346 | 3/1932 | Brown | 212/167 |
| 2,239,750 | 4/1941 | Weeks et al. | 294/65.5 |
| 2,485,362 | 10/1949 | Carper . | |
| 2,646,225 | 7/1953 | Le Desco . | |
| 2,651,538 | 9/1953 | Stahmer | 294/65.5 |
| 2,710,767 | 6/1955 | Howe . | |
| 3,155,328 | 11/1964 | Langley . | |
| 3,799,602 | 3/1974 | Laws et al. | 294/65.5 |
| 3,845,893 | 11/1974 | Banjavich . | |
| 3,869,814 | 3/1975 | Rannev et al. | 212/167 |
| 4,106,682 | 8/1978 | Ramun . | |

FOREIGN PATENT DOCUMENTS

| | | |
|---|---|---|
| 1607449 | 6/1967 | Fed. Rep. of Germany . |

*Primary Examiner*—Joseph F. Peters, Jr.
*Assistant Examiner*—R. B Johnson
*Attorney, Agent, or Firm*—Harpman & Harpman

[57] ABSTRACT

A building is rapidly and inexpensively dismantled by dropping a heavy inverted U-shaped tool on a building or other structure from an elevation thereabove as from the upper outer end of a boom on a crane, the tool is initially suspended from a cable leading back to a winch capable of dropping the tool in a free fall. A secondary cable is attached to one of the arms of the inverted U-shaped tool inwardly from its lower end, the secondary cable leading to a secondary winch of a type capable of exerting great pulling power on the tool once it is engaged in the building or structure being dismantled.

4 Claims, 2 Drawing Sheets

FIG. 1
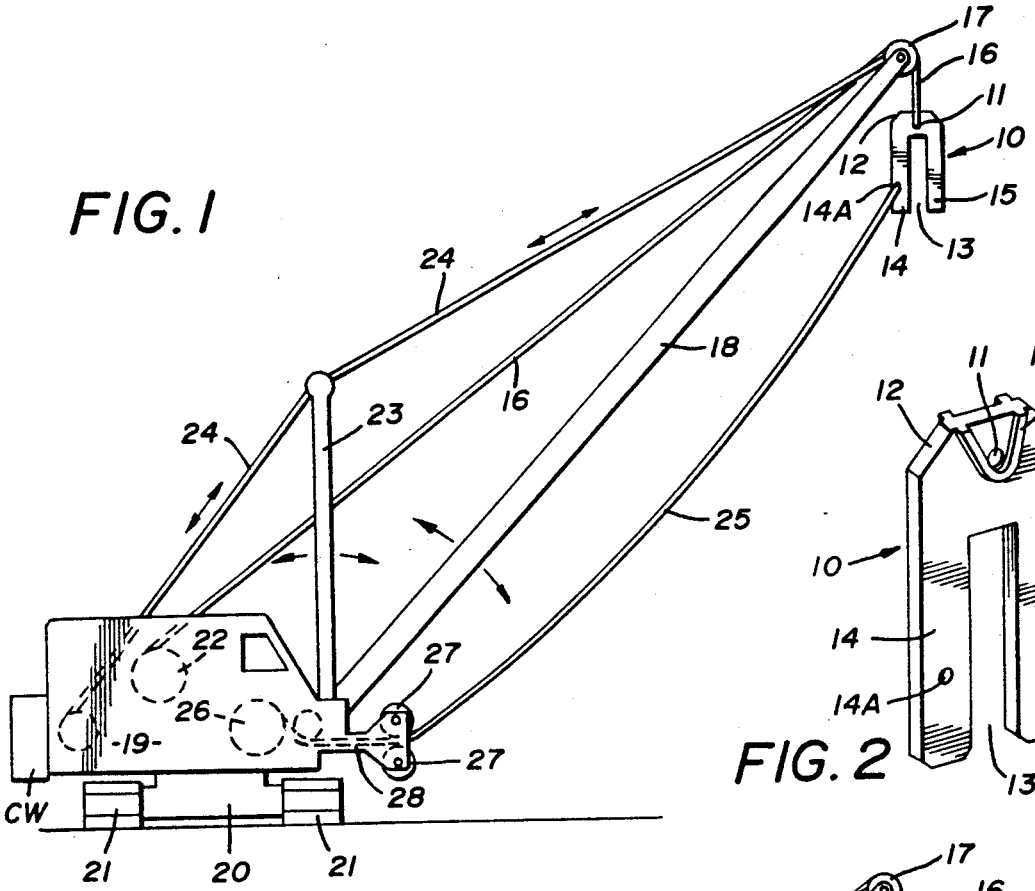
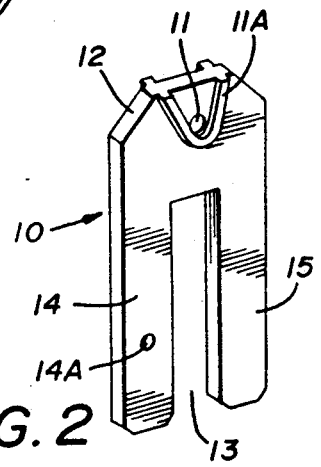
FIG. 2
FIG. 3
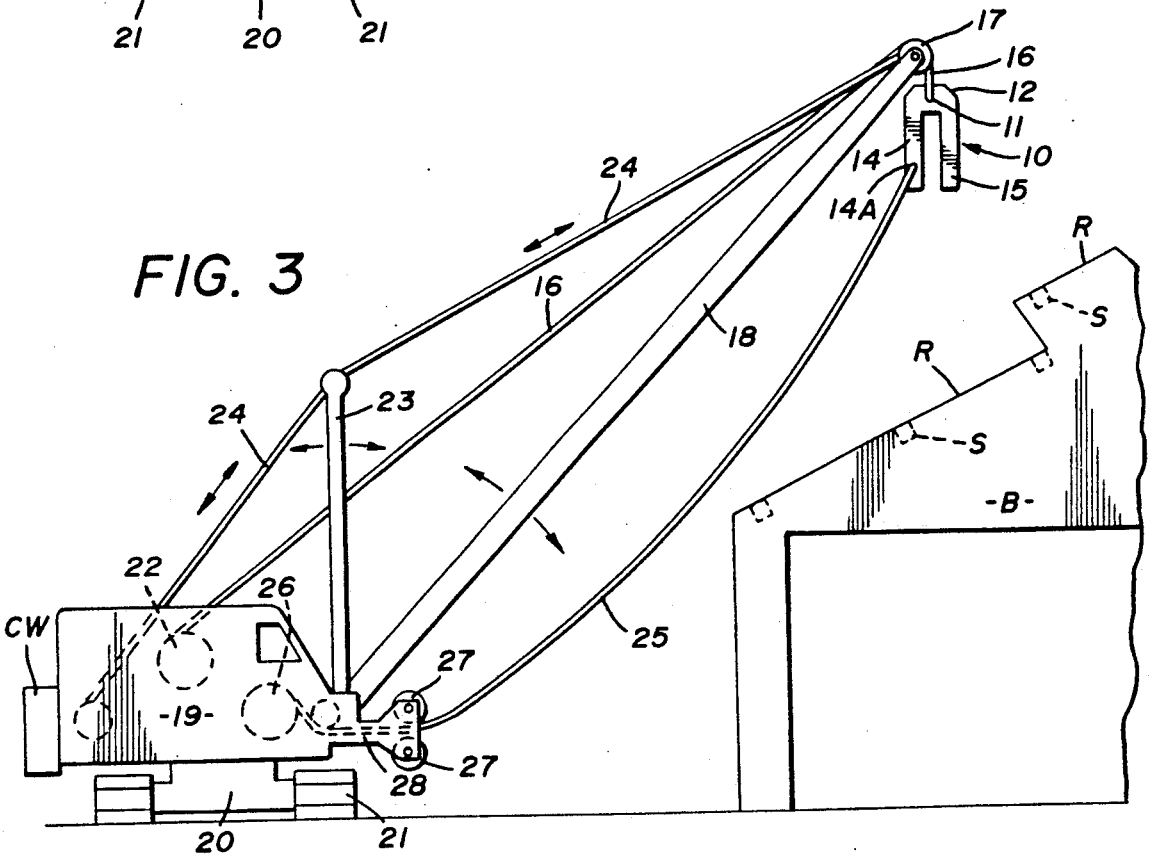

APPARATUS FOR DISMANTLING BUILDINGS

BACKGROUND OF THE INVENTION

1. Technical Field

This invention relates to apparatus for dismantling buildings and similar structures.

2. Description of the Prior Art

The only prior art known to the applicant relates to an early form of the tool used in the present invention which was patented by the applicant's father, Michael Ramun, in U.S. Pat. No. 4,106,682 of Aug. 15, 1978. In the patent, the tool is referred to as a shearing tool for structural members and it was and has been successfully used in shearing horizontal beams adjacent a vertical column supporting the same.

U.S. Pat. No. 1,240,821 of Sept. 25, 1917 illustrates a wheeled vehicle having an elevated outwardly extending horizontal track upon which a buggy is movably mounted. A hammer is suspended from the buggy for the purpose of breaking stone therebeneath. The hammer is elevated by actuation of a cable and winch on the vehicle.

A similar arrangement of a rock crusher, except for the movable carriage, is seen in U.S. Pat. No. 2,485,362 of Oct., 1949.

U.S. Pat. No. 2,646,225 of July, 1953 discloses a crane having a boom carrying a conveyor belt by which a rock crushing weight is moved upwardly and outwardly to the end of the boom so that it may be dropped on a rock to be crushed.

U.S. Pat. No. 2,710,767 of June, 1955 shows a wrecking ball with a hook suspended therefrom, the ball is controlled by a cable extending over a pulley at the end of a boom of a supporting and operating apparatus.

U.S. Pat. No. 3,155,328 of Nov. 1964 shows a backhoe including a bucket and means for moving it and a boom positioning a wrecking weight by means of a cable and a winch for controlling the cable.

U.S. Pat. No. 3,845,893 of Nov. 1974 shows a crane with a cable trained over a pulley on the outermost end of a boom and supporting a chopping tool for demolition of a submerged vessel.

German OLS No. 1,607,449 of Aug. 1969 shows a weight that may be dropped on work surfaces for comminuting or crushing rocks, walls, scrap iron, or the like.

None of the prior art discloses the apparatus of the present invention.

The invention enables a building or like structure to be quickly and easily dismantled by dropping the tool on the building so that it penetrates a roof or other part of the structure being dismantled where it will puncture at least one opening therein and move downwardly therethrough whereupon a second cable secured to a lower part of the tool is moved away from the building or structure being dismantled to effectively pull the structure apart and move it toward the crane controlling the heavy inverted U-shaped tool of the apparatus.

SUMMARY OF THE INVENTION

The apparatus for dismantling buildings disclosed herein consists of a crane having an elongated boom and means for elevating the boom, a first cable controlled by a first winch in the crane is trained over a pulley on the upper, outer end of the boom and suspends a heavy inverted U-shaped tool in a manner that permits the tool to be elevated to a position above a building to be dismantled and dropped thereon in free fall, the weight and shape of the tool causing it to punch and tear at least one opening in the roof of a structure as it is dropped upon as it moves downwardly into the structure. The inverted U-shaped of the tool generally engages a portion of the structure as the tool move downwardly. A second cable secured to one of the arms of the heavy inverted U-shaped tool inwardly from its lower end extends back to the crane and a second winch thereon which enables the actuation of the second winch to pull the heavy inverted U-shaped tool toward the crane and in effect pull down the building in a satisfactory dismantling operation positioning the parts of the building or other structure at or near ground level where they may be easily reduced to workable scrap by a mobile shears, such as disclosed for example in U.S. Pat. No. 4,686,767 and others owned by Allied Gator, Inc. of Youngstown, Ohio, the assignee of the present invention.

DESCRIPTION OF THE DRAWINGS

FIG. 1 is a side elevation of a crane with an elevated boom and the apparatus for dismantling buildings;

FIG. 2 is a perspective elevation of a portion of the apparatus;

FIG. 3 is a side elevation similar to FIG. 1 showing the dismantling apparatus in relation to a building to be dismantled;

DESCRIPTION OF THE PREFERRED EMBODIMENT

Figure 4:
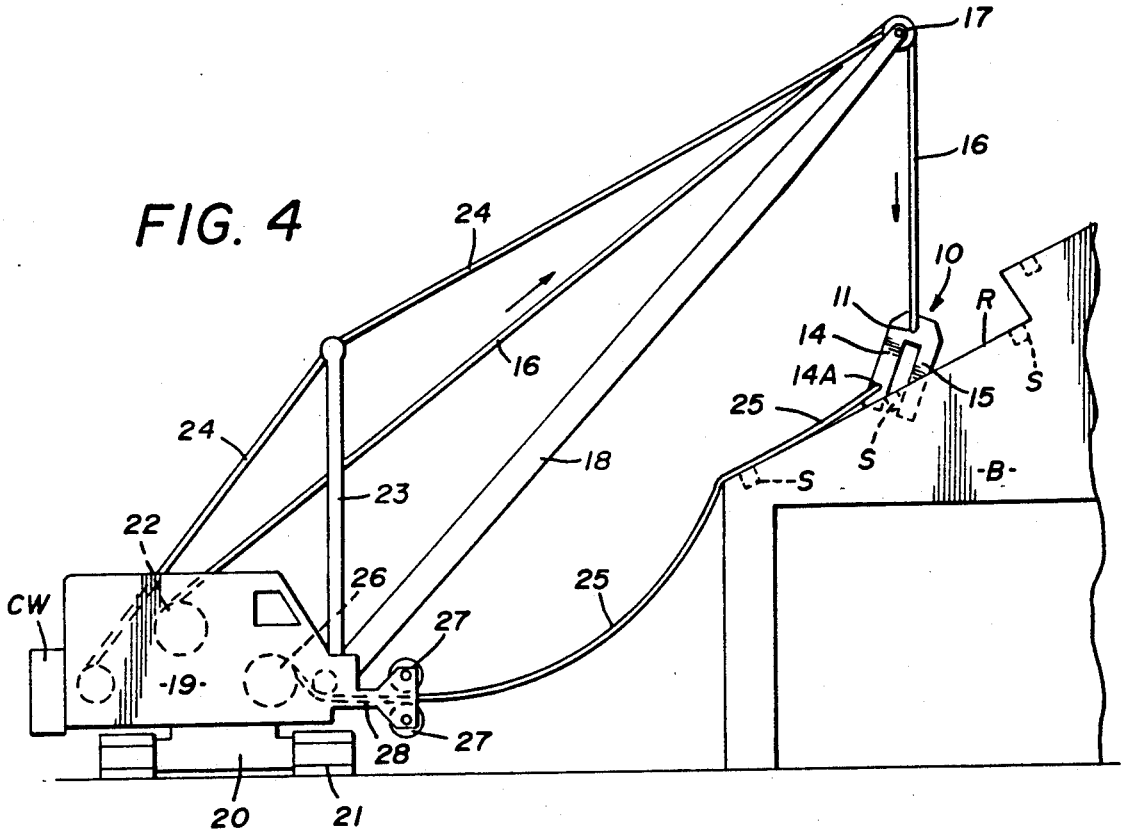
FIG. 4 is a side elevation similar to FIGS. 1 and 3 showing a part of the apparatus engaging a portion of the building to be dismantled.

In its simplest form, the apparatus for dismantling buildings of this invention is comprised of a heavy inverted U-shaped tool 10, preferably formed of cast steel, of a suitable size, for example wherein the overall height or length of the tool is 9'7" having an aperture 11 positioned about 12" inwardly of its upper end 12 and an elongated slot 13 about 16" wide and of a length about 6'7" defining the bifurcated portion of the heavy inverted U-shaped tool 10. The bifurcated portions form arms 14 and 15, each of which is about 18" wide. The heavy inverted U-shaped tool 10 has a thickness at least 4" and may be thickened at its uppermost end around and about the aperture 11 therein if desired.

The approximate weight of the above-described heavy inverted U-shaped tool 10 is about 9500 lbs. which will obviously vary when larger or smaller tools are provided for use in dismantling buildings or the like.

The tool 10, as illustrated in FIGS. 1,2,4 and 5 is attached at its uppermost end to a first cable 16 which is trained over a pulley 17 on the upper outer end of a boom 18 of a crane 19, which is rotatably mounted on a support frame 20 along with movable continuous ground engaging interconnected treads 21. The first cable 16 is controlled by a first winch 22 in the crane 19. The winch is of a type that is free running in one direction, such as unwinding the first cable 16 and powered in the reverse winding operation so that the heavy inverted U-shaped tool 10 can be dropped in free falling motion from the positions illustrated in FIGS. 1 and 2 of the drawings for a falling forceful penetrating and shearing action on a building such as illustrated in FIGS. 2 and 3 of the drawings.

Referring again to FIG. 1 of the drawings, it will be seen that the crane 19 is provided with a typical secondary boom 23 over which suitable boom position controlling cables 24 are positioned, some of which extend to the outer upper end of the boom 18 as will be understood by those skilled in the art and some of which extend between the upper end of the secondary boom 23 and a boom controlling winch, as shown, in the crane 19, all of which enable the crane operator to move the boom 18 in a vertical pattern as will be understood by those skilled in the art.

In the present invention, the boom is of a length sufficient to extend upwardly and outwardly to a position above a typical mill building, or the like to be dismantled, it being understood that such mill buildings and the like frequently have a vertical height comparable with a five or sixty-story conventional multistory building. A counterweight CW offsets the tool 10 weight.

Still referring to FIG. 1 of the drawings, it will be seen that the apparatus for dismantling buildings includes a second cable 25 which is attached to the arm 14 of the bifurcated portion of the heavy inverted U-shaped tool 10. The second cable 25 is engaged on a second winch 26 in the crane 19 and is positioned between a pair of guiding rollers 27 positioned one above the other on an extension 28 of the crane 19.

In operation, the crane 19 is positioned adjacent a building to be demolished as illustrated in FIG. 3 of the drawings, with the upper outer end of the boom 18 positioned thereabove by the action of the first winch 22 winding up and thereby shortening the first cable 16, the winch 26 controlling the second cable 25 is actuated to unwind sufficient portion of the second cable 25 to permit the tool 10 to fall freely into the building being demolished, the roof portion of which is indicated in FIG. 3 by the letter R and the building itself by the letter B. Broken line representation of roof or other building structures S are also indicated. The free fall is by gravity only.

The tool 10, which is best illustrated in the perspective elevation of FIG. 2 of the drawings, has a raised semi-V-shaped configuration 11A on its front and back sides at either side of and below the aperture 11 which extends through the body of the tool 10 adjacent its upper end and the uppermost portion of the tool 10 is preferably somewhat thinner than the lowermost portion so as to provide areas on both sides of the upper end portion of the tool 10 defined by the semi-V-shaped curved members 11 A that will protect the end portions of the first cable 16 which is passed through the aperture 11. Such protection is highly desirable when the tool 10 is dropped by gavity on a building being dismantled to insure the protection of the first cable 16 from shearing action which might otherwise occur as the tool 10 drops through a metal structure such as roofing or a beam supporting a roof in a building being dismantled.

Figure 5:
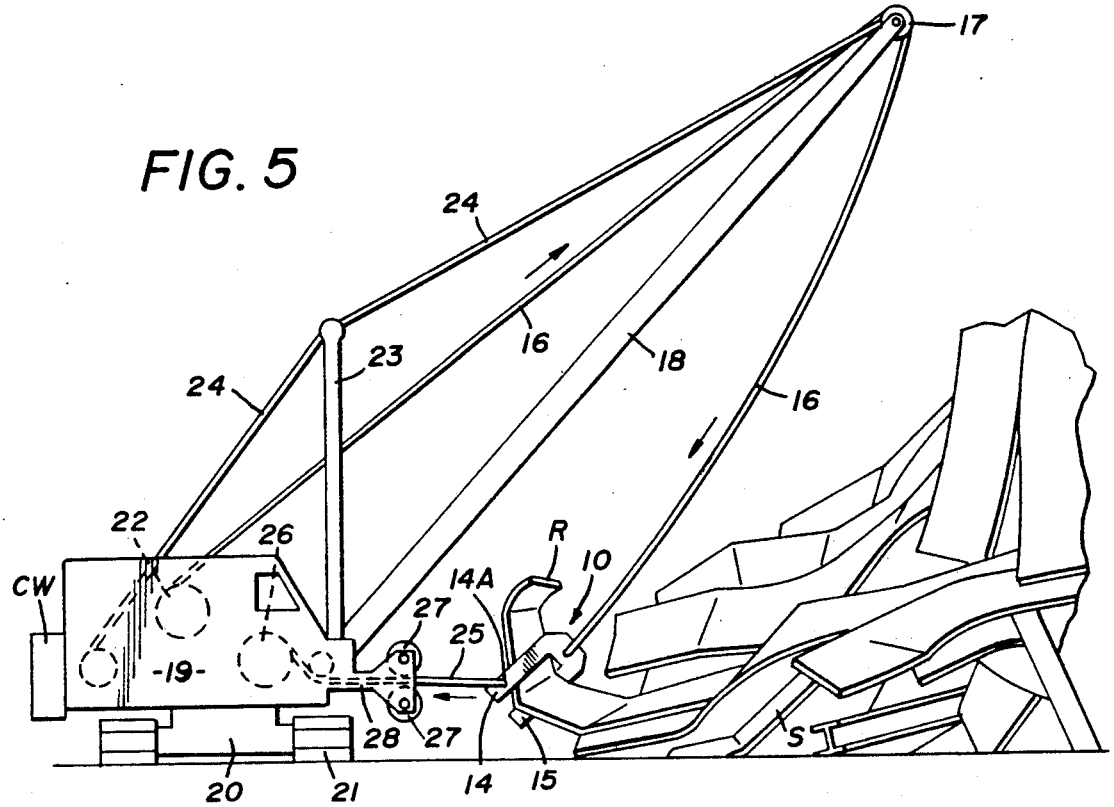
FIG. 5 is a view similar to FIGS. 3 and 4 and showing the apparatus engaged in parts of the building moved toward the crane in a dismantling action.

By referring now to FIG. 4 of the drawings, it will be seen that the tool 10 has been allowed to drop freely by causing the first winch 22 in the crane 19 to unwind or unreel the first cable 16 without any tension thereon and that the second cable 25 has been laid out or unreeled sufficiently to offer no resistance to the falling pattern of the tool 10 although a small amount of tension applied to the second cable 25 will tilt the tool 10 if desired so that one of the arms 14 or 15 will engage the metal structure, for example the roof R, of the building being dismantled before the engagement of the other arm and thus insure the piercing and tearing action necessary to permit the tool 10 to drop substantially into or through the roof R to be sure that the tool 10 is sufficiently engaged therein so that subsequent tension applied to the second cable 25 by the second winch 26 of the crane will pull the area of the building engaged away from the remainder and down into a ground engaging position as shown in FIG. 5 of the drawings.

In FIG. 4 of the drawings, the tool 10 is shown in its initial engagement with the roof R of the building being dismantled and partially engaged over one of the supports S which will insure the pulling down and separation of the various metal parts of the roof R and its supporting structure S to accomplish the dismantling of the building as hereinbefore described as bringing the several parts of the building down to ground level or slightly above where a mobile shear on a backhoe can readily engage and cut the parts of the building into usable metal scrap.

By referring now to FIG. 5 of the drawings, it will be seen that the aforesaid action has occurred, the tool 10 having penetrated the roof R of the building being dismantled and/or become engaged upon a portion of the supporting structure thereof whereupon the second winch 26 is activated and the second cable 25, which is attached to the arm 14 of the tool 10 by way of an aperture 14A therein upwardly from the lowermost end of the arm 14, has been forcibly moved toward the crane 19 by the second winch 26 so as to pull the sections of the roof off and the structure S of the building being dismantled and engaged by the tool 10 toward the crane 19 thus easily and quickly pulling down the associated portions of the building in which the tool 10 was engaged to the positions illustrated in FIG. 5 of the drawings where, as hereinbefore described, a mobile shear on a backhoe can easily gather up the torn down portions of the building and cut them into usable, saleable, scrap sizes.

In FIGS. 1 and 3 of the drawings, the first cable 16 and second cable 25 are illustrated in stationary position. In FIG. 4 of the drawings, the cable 25 is illustrated in slack position slightly unreeled with respect to the second winch 26 in the crane 19 while the first cable 16 is shown moving in an unreeling free falling action by arrors indicating the free fall action of the tool 10 into the building being dismantled.

In FIG. 5 of the drawings, the first cable 16 is shown in slack position and moving outwardly with respect to the crane 19 and downwardly toward the tool 10 freely as indicated by the arrows, while the second cable 25 is indicated by an arrow as being moved toward and reeled in by the second winch 26 after first passing between the guiding rollers 27 on the crane extension 28 to the position illustrated in FIG. 5 of the drawings.

Those skilled in the art will observe that if desired, the operator of the crane can apply some tension to the first cable 16 during this pull down dismantling action and raise the portion or portions of the building engaged by the tool 10 in desired degree to permit them to be partially separated from the remainder of the parts of the building being dismantled so as to position them in more desirable relation for eventual shearing as hereinbefore described.

It will thus be seen that an apparatus for dismantling buildings has been disclosed which permits an efficient method of dismantling the buildings to be used, namely suspending a tool adapted to be engaged in a building to be dismantled above said building, dropping said tool in free fall onto said building so as to punch, tear, and engage or pass through an opening formed therein by the tool, moving the tool away from the building in which it is engaged so as to tear down the engaged portion or portions thereof and positioning said portions away from said building being dismantled for further processing into scrap or sorting as to size and shape.

The method hereinabove described cannot be accomplished by any apparatus heretofore known in the art and those skilled in the art will observe that the method and the apparatus on which it is dependent enable a metal building for example to be quickly and easily dismantled without the heretofore believed necessary use of a crew of workman with cutting torches and associated cranes and grapples to handle these portions of the building freed by the workman and their cutting torches.

Having thus described my invention, what I claim is:

1. An apparatus for dismantling a building comprising:

a crane having an elongated boom with an outer end, means for moving said boom relative to said crane in a vertical plane, first and second winches rotatably mounted on said crane, first and second cables, respectively, operatively engaged with said first and second winches, respectively, an end portion of said first cable being trained over said outer end of said boom for movement relative thereto;

a metal inverted U-shaped tool with a front side and a back side, a raised semi-v-shaped configuration mounted on each of said sides at the upper end of said tool, a first aperture mounted in said tool adjacent the upper end thereof within said raised semi-v-shaped configuration, said inverted U-shaped tool including bifurcated arms, a second aperture mounted in one of said arms adjacent the lowermost end thereof;

an end of said first cable being engaged in said first aperture, an end of said second cable being engaged in said second aperture;

a pair of vertically spaced roller guides mounted on said crane outwardly of said second winch for guiding said second cable between said second winch and said second aperture;

whereby said inverted U-shaped tool may be dropped by gravity by an unreeling action of said first winch for engagement in said building to be dismantled and whereby a reeling in action by said second winch on said second cable moves said inverted U-shaped tool engaged in said building toward said crane so as to pull down and dismantle at least a portion of said building.

2. The apparatus of claim 1 wherein said metal inverted U-shaped tool is about 9½ feet long, about 4 inches thick and its inverted U-shape is defined by an elongated slot about 6½ feet long and about 16 inches wide and its overall width is about 4 foot, 4 inches, the length of the tool beyond the elongated slot is about 3 feet, said first aperture in which said free end of said first cable is engaged is formed in said tool beyond said elongated slot and inwardly of said upper end of said tool about 1 foot.

3. The apparatus of claim 1 wherein said metal inverted U-shaped tool is about 9½ feet long, about 4 inches thick and its inverted U-shape is defined by an elongated slot about 6½ feet long and about 16 inches wide and its overall width is about 4 feet, 4 inches, the length of the tool beyond said elongated slot is about 3 feet, said second aperture in which said free end of said second cable is engaged is formed in one of the bifurcated arms of said metal inverted U-shaped tool and inwardly of said lower end of said tool about 1 foot.

4. The apparatus of claim 1 and wherein said metal inverted U-shaped tool weighs about 9500 pounds.

* * * * *